US006682027B1

(12) United States Patent
Chang

(10) Patent No.: US 6,682,027 B1
(45) Date of Patent: Jan. 27, 2004

(54) BASE SEAT OF GOLF BAG

(76) Inventor: Bei-Yui Chang, 2 F, No. 263, Sec. 1, Jian-Guo South Road, Taichung City (TW)

( * ) Notice: Subject to any disclaimer, the term of this patent is extended or adjusted under 35 U.S.C. 154(b) by 0 days.

(21) Appl. No.: 10/342,381

(22) Filed: Jan. 15, 2003

(30) Foreign Application Priority Data

Dec. 17, 2002 (TW) ..... 91220597

(51) Int. Cl.[7] ..... A63B 55/00
(52) U.S. Cl. ..... 248/96; 206/315.3; 206/315.7
(58) Field of Search ..... 248/95, 96, 97; 206/315.3, 315.7, 315.8

(56) References Cited

U.S. PATENT DOCUMENTS 6,098,797 A * 8/2000 Han ..... 206/315.7
6,220,433 B1 * 4/2001 Kang ..... 206/315.7
6,315,117 B1 * 11/2001 Han ..... 206/315.7
6,386,362 B1 * 5/2002 Cheng ..... 206/315.3
6,412,734 B2 * 7/2002 Lin ..... 248/96
6,564,937 B1 * 5/2003 Cheng ..... 206/315.7

* cited by examiner

*Primary Examiner*—Gwendolyn Baxter
(74) *Attorney, Agent, or Firm*—Rosenberg, Klein & Lee

(57) ABSTRACT

A base seat of golf bag is disclosed. It includes a base board, a front flexible stop plate section, a fixed rear jaw section, a front socket, and a rear socket. The base board has a front jaw section that can be slightly up and down biased by an angle. This front flexible stop plate section is disposed between the base board and the front jaw section. The base board of the base seat always keeps entirely contacting with the ground so that the frictional force against the ground is greater and the base seat can be stably placed on the ground. The golf bag with the base seat can be inclined by any arbitrary angle within a range.

5 Claims, 6 Drawing Sheets

BASE SEAT OF GOLF BAG

BACKGROUND OF THE INVENTION

The present invention is related to a base seat of golf bag, which always keeps entirely contacting with the ground in both upright state and inclined state. Therefore, the golf bag with the base seat can be stably placed on the ground. In addition, the golf bag with the base seat can be inclined by any arbitrary angle.

FIGS. 1 and 2 show a conventional golf bag having a top section 91, a bag section 92 and a base section 93. A stretchable leg support 94 is connected with the top section 91. The bag section 92 is supported by a front and a rear support rods 81, 82 for containing golf clubs 95. The base section 93 has a slope section 931 and a plane section 932.

FIG. 1 shows that the golf bag is placed upright, while FIG. 2 shows that the golf bag is placed in an inclined state.

It should be noted that when the golf bag is placed in an inclined state (by a certain angle), the golf bag is supported by the slope section 931 of the base section 93 and two leg supports 94 at three points.

However, the slope section 931 contacts with the ground by small area so that the golf bag is unstable and tends to slip on the grounds of some golf courses.

On the other hand, in the case that the golf bag is placed upright, the plane section 932 of the base section 93 contacts with the ground, while the slope section 931 is lifted away from the ground. The gravity center of the golf bag is at the center thereof. However, only the right side of the golf bag contacts with the ground so that the golf bag can be hardly stably placed on the ground. Especially when the golf clubs 95 are concentrated on the slope section 931 (left side), the gravity center is moved to the left side. Under such circumstance, the golf bag is very likely to tilt down. The ground of golf course is sloped and irregular. This makes the conventional golf bag easier to tilt down.

Furthermore, the base section of the conventional golf bag simply has a slope section 931 and a plane section 932. Therefore, the golf bag can be placed in an upright state or placed in an inclined state by a specific angle. The golf bag cannot be inclined by larger or smaller inclination angle.

SUMMARY OF THE INVENTION

It is therefore a primary object of the present invention to provide a base seat of golf bag, which always keeps entirely contacting with the ground in both upright state and inclined state. Therefore, the golf bag with the base seat can be stably placed on the ground.

It is a further object of the present invention to provide the above base seat of golf bag, which can be inclined by any angle.

The present invention can be best understood through the following description and accompanying drawings wherein:

DETAILED DESCRIPTION OF THE PREFERRED EMBODIMENTS

Figure 1:
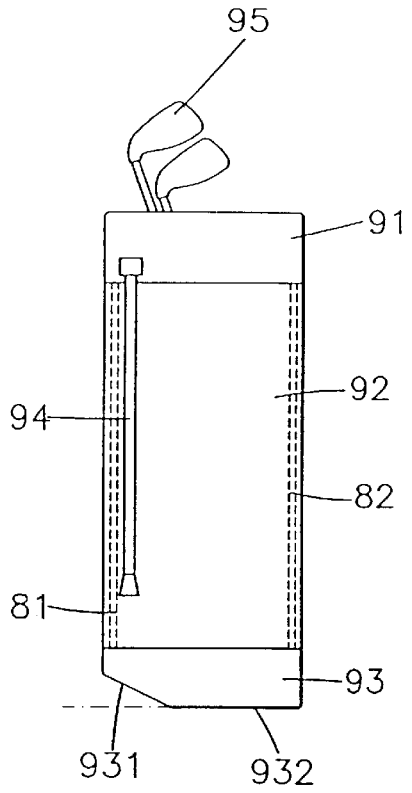
FIG. 1 (PRIOR ART)
FIG. 1 is a side view of a conventional golf bag in an upright state.
Figure 2:
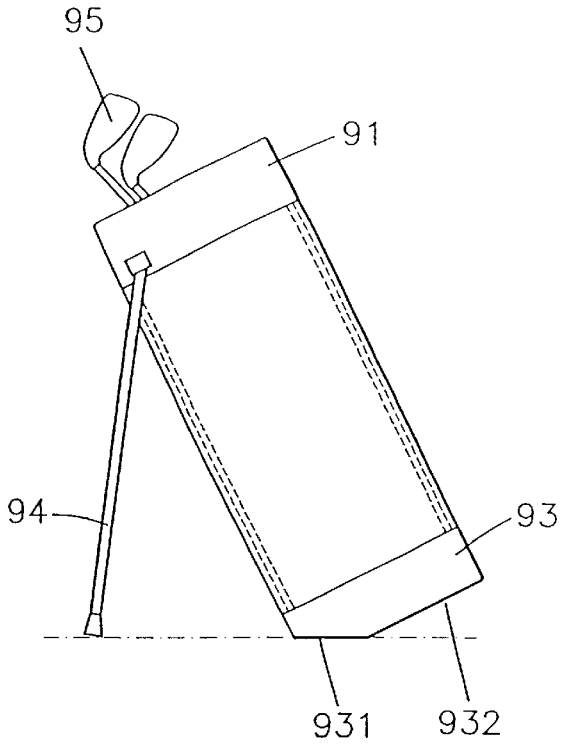
FIG. 2 (PRIOR ART)
FIG. 2 is a side view of a conventional golf bag in an inclined state.
Figure 3:
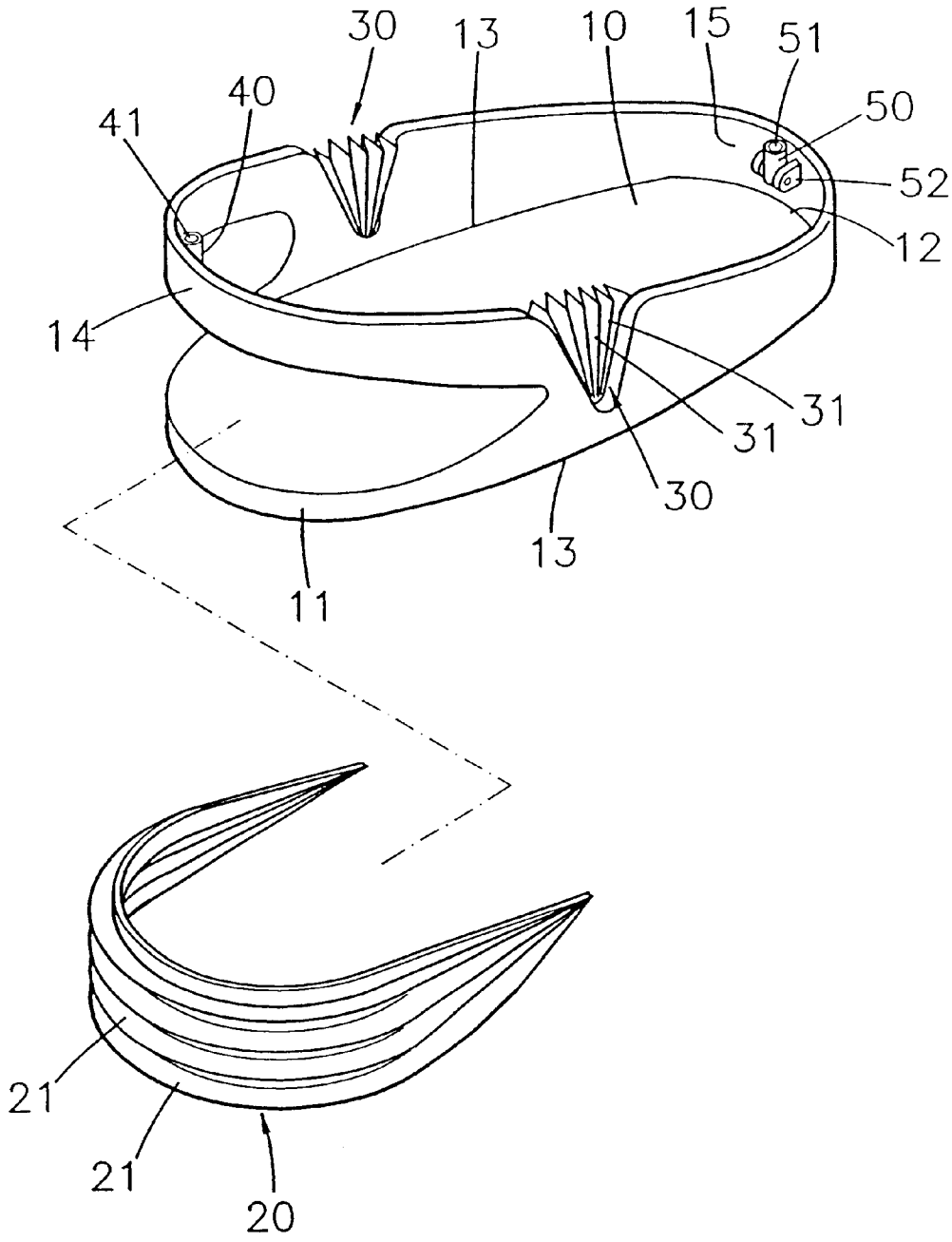
FIG. 3 is a perspective exploded view of the base seat of the present invention.
Figure 4:
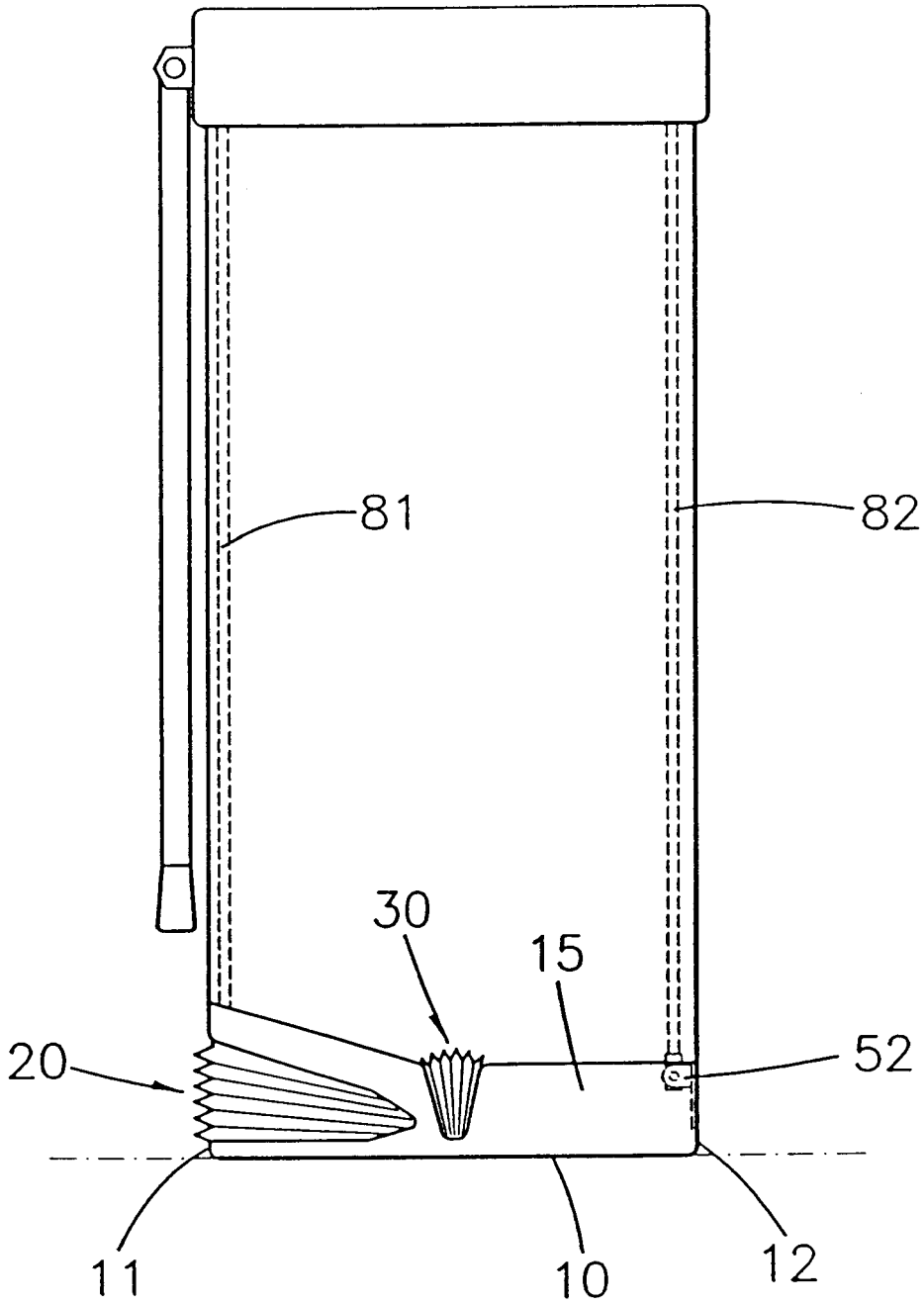
FIG. 4 is a side view of a golf bag with the base seat of the present invention in an upright state.
Figure 5:
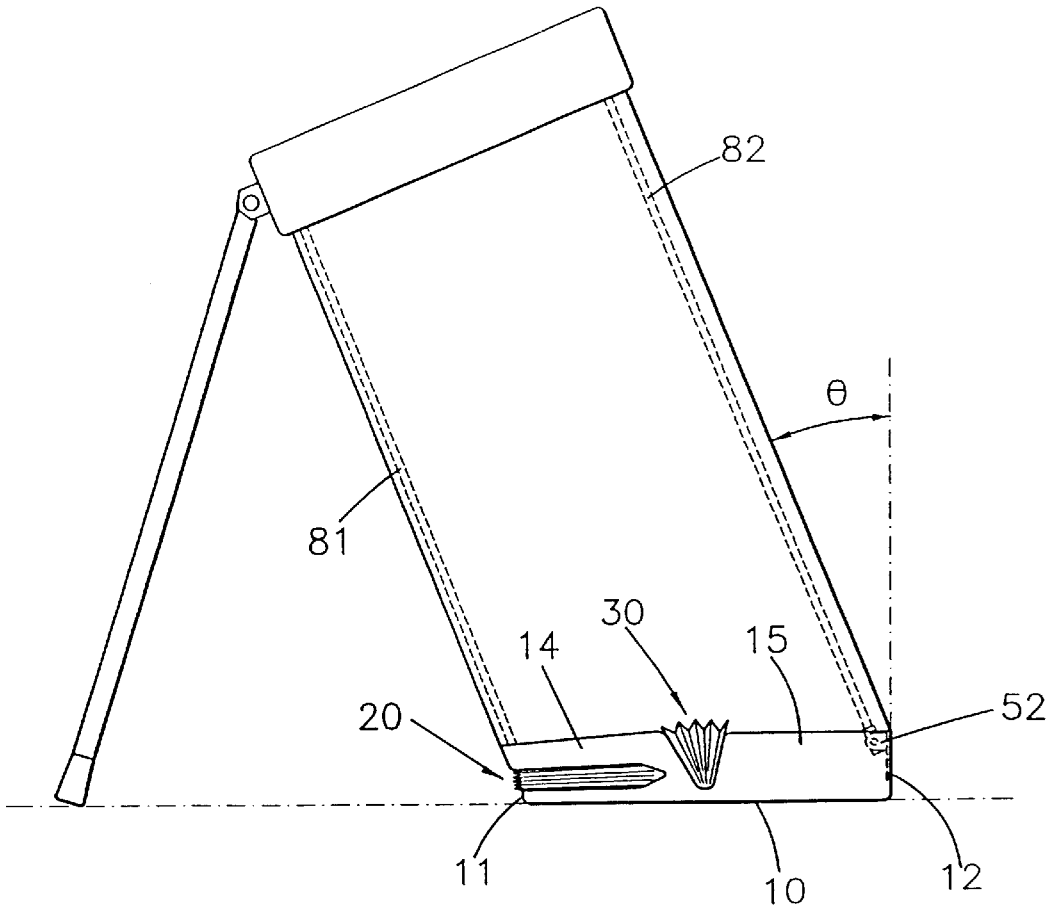
FIG. 5 is a side view of a golf bag with the base seat of the present invention in an inclined state.

Please refer to FIGS. 3 to 5. The base seat of golf bag of the present invention includes a base board 10, front flexible stop plate section 20, a pair of lateral flexible stop plate sections 30, a front socket 40 and a rear socket 50.

The base board 10 is preferably made of slightly flexible material such as plastic or rubber. The base board 10 has a front edge 11, a rear edge 12 and two lateral edges 13. A front jaw section 14 integrally upward and forward extends from the lateral edges 13 of the base board 10. The front jaw section 14 can be slightly up and down biased by a predetermined angle θ (referring to FIG. 7). The front edge 11 and the front jaw section 14 define therebetween a predetermined space. A fixed rear jaw section 15 integrally upward extends from the lateral edges 13 and rear edge 12 of the base board 10.

The front flexible stop plate section 20 is disposed between the base board 10 and the front jaw section 14. The front flexible stop plate section 20 has multiple substantially horizontal arched front fold units 21.

The lateral flexible stop plate sections 30 are disposed between the front jaw section 14 and the rear jaw section 15. Each lateral flexible stop plate section 30 has multiple substantially vertical lateral fold units 31.

The front socket 40 is disposed on inner side of the front jaw section 14 and has a front insertion hole 41 facing upward.

The rear socket 50 is pivotally fixed on inner side of the rear jaw section 15 via a pivot member 52 and has a rear insertion hole 51 facing upward.

In this embodiment, the predetermined bias angle of the front jaw section 14 is smaller than 60 degrees.

Figure 6:
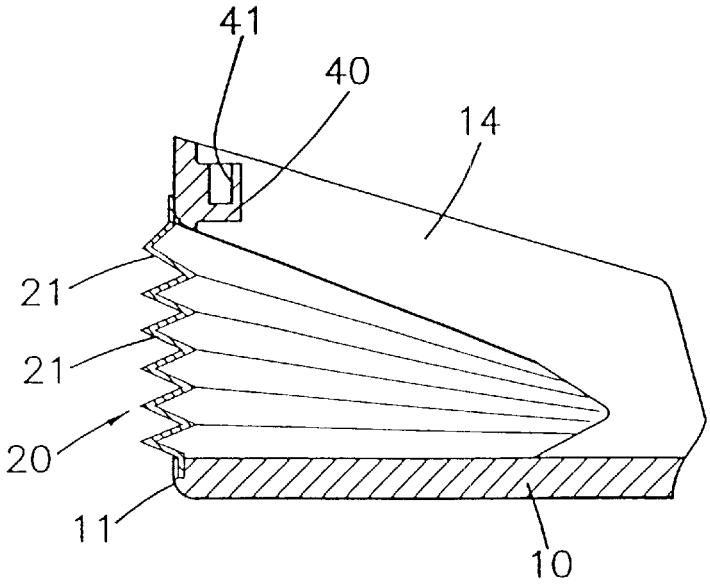
FIG. 6 shows the front flexible stop plate section of the present invention in an upright state.

FIGS. 4 and 6 show that the present invention is mounted on a golf bag placed in an upright state. In this state, the front jaw section 14 is in an original state and the multiple front fold units 21 of the front flexible stop plate section 20 are in a loosened state. A front and a rear support rods 81, 82 (both upright) are respectively fixed in the front and rear sockets 41, 51.

Figure 7:
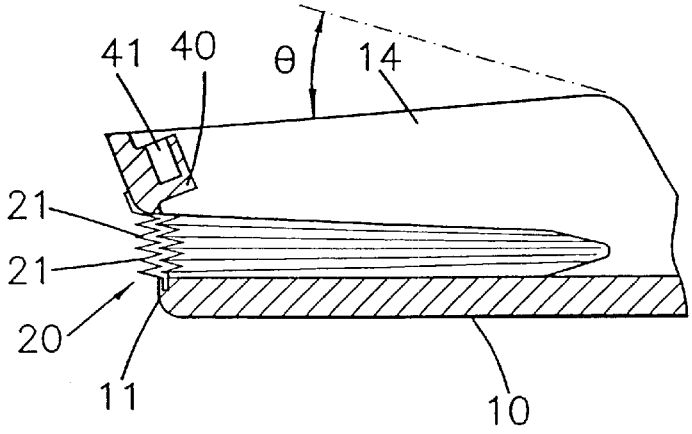
FIG. 7 shows the front flexible stop plate section of the present invention in an inclined state.

In use, a user presses down the front end of top face of the golf bag with a hand and simultaneously inclines the golf bag and opens the leg supports. At this time, the golf bag is changed into an inclined state as shown in FIGS. 5 and 7. Under such circumstance, the front jaw section 14 is slightly deformed and bent downward and the multiple front fold units 21 of the front flexible stop plate section 20 are in a compressed state. In addition, the front support rod 81 on the front socket 41 is driven by the front jaw section 14 and tilted. The rear support rod 82 on the rear socket 51 is pivoted on the pivot member 52 and inclined by the same angle. No matter what inclination angle the golf bag is (any arbitrary angle within 0–60 degrees), the bottom face of the base seat of the present invention always keeps contacting with the ground by the same area. Therefore, the frictional force of the base seat against the ground is quite strong.

However, when the user folds the leg supports and erects the golf bag in the upright state as shown by FIGS. 4 and 6, the front jaw section 14 due to the restoring force of its own material restores to its original state. Therefore, it is very convenient to operate and use the present invention.

Figure 8:
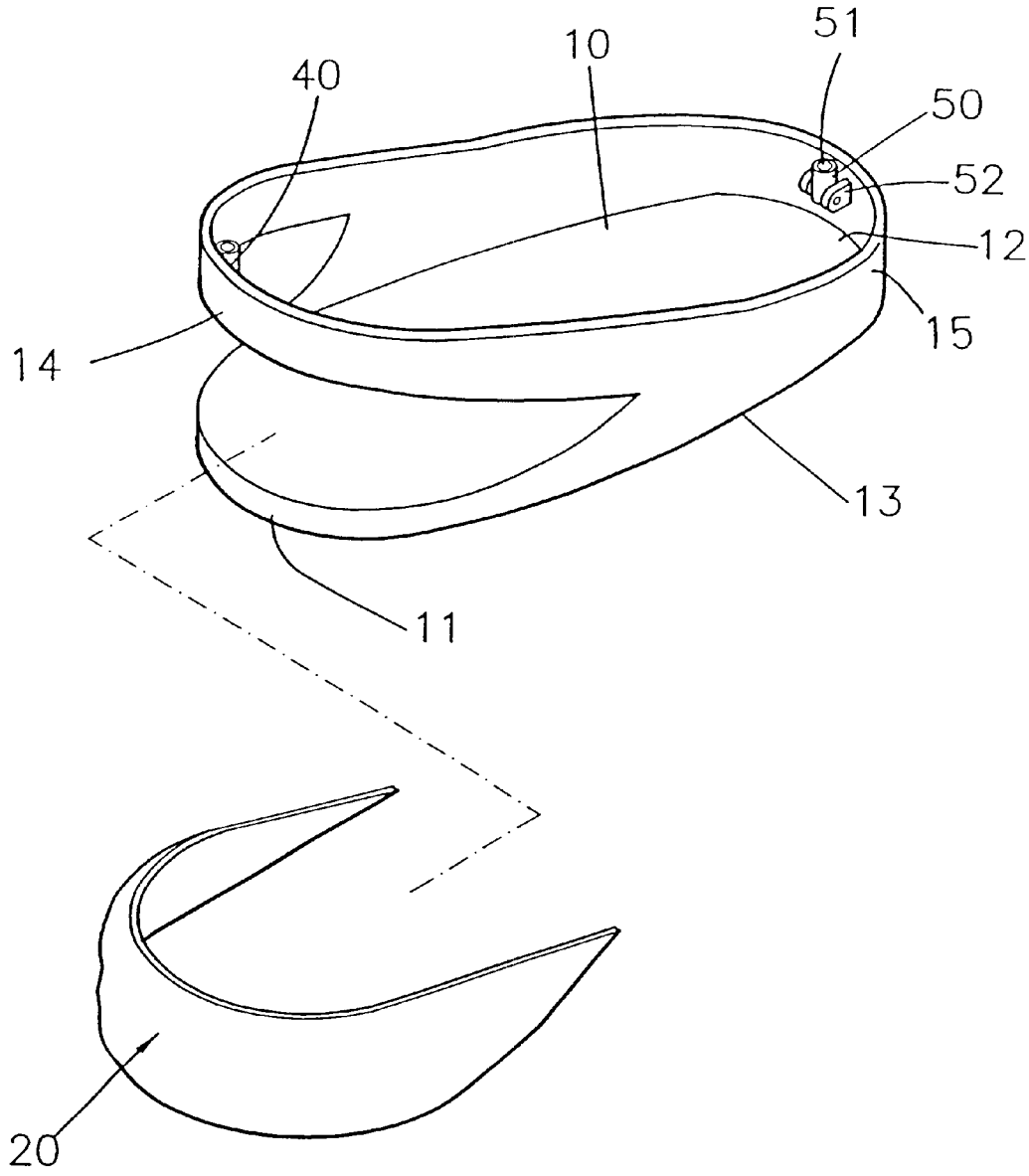
FIG. 8 is a perspective exploded view of another embodiment of the base seat of the present invention.

FIG. 8 shows another embodiment of the present invention, in which the front flexible stop plate section 20 is replaced by a thin fabric such as canvas or plastic sheet. In addition, the front jaw section 14 is integrally connected with the rear jaw section 15 without the lateral flexible stop plate sections 30. This embodiment can achieve the same effect as the one of the first embodiment.

According to the above arrangement, the present invention has the following advantages:

1. The base seat is stable. The base board 10 of the present invention always keeps entirely contacting with the ground so that the frictional force against the ground is greater. Therefore, the golf bag with the base seat of the present invention can be stably placed on the sloped and irregular lawn of a golf course.

2. The golf bag with the base seat of the present invention can be inclined by any arbitrary angle (within a range). By means of the inclinable front jaw section and pivotable rear jaw section of the present invention, the golf bag can be inclined by one degree, 5 degrees, 10 degrees, 30 degrees, 39.7 degrees or any other angle.

The above embodiments are only used to illustrate the present invention, not intended to limit the scope thereof. Many modifications of the above embodiments can be made without departing from the spirit of the present invention.

What is claimed is:

1. Base seat of golf bag, comprising:

a base board having a front edge, a rear edge and two lateral edges, a front jaw section integrally upward and forward extending from the lateral edges of the base board, whereby the front jaw section can be slightly up and down biased by a predetermined angle, the front edge and the front jaw section defining therebetween a predetermined space, a fixed rear jaw section integrally upward extending from the lateral edges and rear edge of the base board;

a front flexible stop plate section disposed between the base board and the front jaw section;

a front socket disposed on inner side of the front jaw section and having a front insertion hole substantially facing upward; and a rear socket pivotally fixed on inner side of the rear jaw section via a pivot member and having a rear insertion hole substantially facing upward.

2. Base seat of golf bag as claimed in claim 1, wherein the predetermined biasing angle of the front jaw section is smaller than 60 degrees.

3. Base seat of golf bag as claimed in claim 2, further comprising a pair of lateral flexible stop plate sections disposed between the front jaw section and the rear jaw section.

4. Base seat of golf bag as claimed in claim 3, wherein the front flexible stop plate section has multiple substantially horizontal arched front fold units and each lateral flexible stop plate section has multiple substantially vertical lateral fold units.

5. Base seat golf bag as claimed in claim 1, wherein the front jaw section is integrally connected with the rear jaw section.

* * * * *